United States Patent [19]

Marks

[11] 4,429,802

[45] Feb. 7, 1984

[54] LINERLESS CLOSURE CAP

[75] Inventor: Walter J. Marks, Mississauga, Canada

[73] Assignee: Anchor Hocking Corporation, Lancaster, Ohio

[21] Appl. No.: 383,285

[22] Filed: May 28, 1982

[51] Int. Cl.[3] ..... B65D 41/04

[52] U.S. Cl. ..... 215/344; 215/DIG. 1

[58] Field of Search ..... 215/344, DIG. 1, 343

[56] References Cited

U.S. PATENT DOCUMENTS 3,246,784 4/1966 Scharf et al. ..... 215/343 X 3,815,771 6/1974 Marks ..... 215/344

4,322,012 3/1982 Conti ..... 215/344

*Primary Examiner*—Donald F. Norton

*Attorney, Agent, or Firm*—Holland, Armstrong, Wilkie & Previto

[57] ABSTRACT

A one-piece molded closure cap having a cover and a depending skirt. There are container engaging means on the skirt for engaging cap engaging means on the container. There is a downwardly projecting sealing rim on the underside of the cap cover positioned for engaging the container rim. The sealing ring has a flared and curving radially inner corner sealing surface including an intermediate ring-like top scaling projection.

6 Claims, 5 Drawing Figures

LINERLESS CLOSURE CAP

The present invention relates to an improved linerless closure cap of the type used to seal beverage and other containers and more particularly to a one piece molded plastic closure cap having an improved sealing means formed as an integral portion of the closure cap cover.

Linerless, molded, plastic closure caps have now been used for some time, as for example, closure caps of the type described in my Canadian Pat. Nos. 955,886 and 987,260 dated Oct. 8, 1974 and Apr. 13, 1976 respectively and my corresponding U.S. Pat. No. 3,815,771, dated June 11, 1974. The closure cap of this invention represents a significant improvement upon these prior linerless closure caps.

Closure caps of this general type are one piece caps molded of plastic with all elements of the cap including the sealing means or cap gasket comprising integral parts of the molded closure. The caps are characterized by having sealing fins or rings formed on the underside of the cap covers where the rings are an integral molded portion of the cap inner cover surface. These caps are particularly useful on beverage containers, including alcoholic beverages or other alcoholic containing mixtures where an excellent evaporation proof seal must be provided. Such a seal, for example, must be sufficiently tight to be effective with container pressures in excess of about 40 pounds and for preventing evaporation losses from easily vaporized products, including alcoholic beverages. The closure caps of the present invention have sealing rings with significantly improved shaping to achieve this object in a closure cap which is readily manufactured and which in particular is easily stripped from the cap forming mold. The cap has a sealing ring with a flared and curving radially innermost surface for forming a corner seal and includes an intermediate shorter ring-like top sealing projection.

Accordingly, an object of the present invention is to provide an improved linerless closure cap.

Another object of the present invention is to provide an improved molded linerless closure cap for particular use in effectively sealing at high pressures.

Another object of the present invention is to provide caps achieving the above objects and which are readily molded and easily stripped from conventional cap molding machinery.

Another object of the present invention is to provide an improved linerless closure cap for sealing containers, including glass containers.

Other and further objects of the present invention will become apparent upon an understanding of the illustrative embodiments about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings, forming a part of the specification, wherein.

Figure 1:
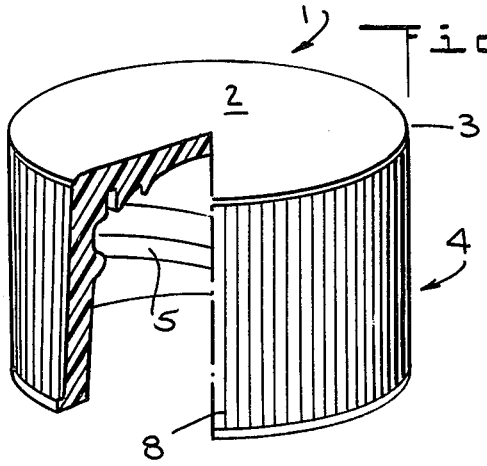
FIG. 1 is a perspective view, partially cut away, illustrating the preferred closure cap of the invention.
Figure 2:
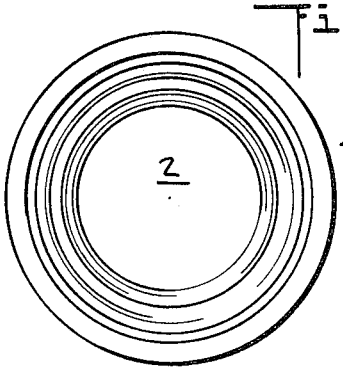
FIG. 2 is a top plan view of the closure cap of FIG. 1.

A closure cap 1 in accordance with the present invention has a relatively flat cover 2 with a generally circular edge 3 terminating in a downwardly extending cylindrical skirt 4. There are a number of container engaging members or threads 5 formed on the interior surface of the skirt 4 which engage cooperating fastening members 6 (FIG. 4) on the container 7. In the illustrated embodiment, these comprise continuous threads 5 formed on the inner skirt 4 surface and threads 6 on the container. In order to facilitate cap application and removal, the outer skirt 4 surface preferably has knurls 8 for facilitating the gripping of the closure cap 1 during application or removal.

The closure cap 1 has a generally flat inner cover surface 9 which faces the container rim 10 during cap application. An improved sealing means is formed as an integral portion of the cap cover surface 9 during the molding of the closure.

Figure 3:
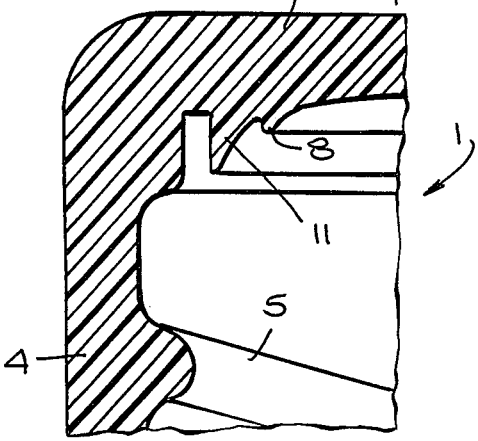
FIGS. 3 and 4 are enlarged fragmentary sectional views of the closure cap of FIG. 1 before and after application to a container.
Figure 4:
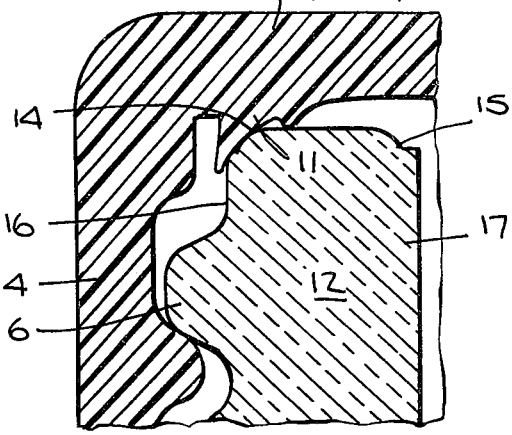

FIGS. 3 and 4 illustrate an improved sealing ring 11 in accordance with the present invention with FIG. 3 showing the sealing ring 11 prior to the application of the closure cap to a container and with FIG. 4 illustrating the sealing ring 11 in engagement with the rim 10 of a sealed container 12. The rim 10 comprises a generally flat upward facing rim surface 13 which has rounded corners 14 and 15 leading to the container outer rim surface 16 and inner rim surface 17 respectively. Relatively slight angular areas on the outer and inner rim corners result from the action of typical container rim mold rings.

The sealing ring 11 on the under surface of the closure cap cover 2 is positioned to be turned downwardly into sealing engagement with the outer corner 14 of the container rim 10. This sealing engagement is illustrated, for example, in FIG. 4 which shows a closure cap 1, in accordance with the present invention, in sealing engagement with a typical bottle or other container 12. In this position, the sealing rib 11 has been moved into engagement with the outer corner 14 of the rim 10 and has engaged at least the uppermost and lowermost portions of the container corner leaving only a minor portion of the corner, if any, out of sealing engagement with the sealing ring 11.

Additionally, a seal has also been made between an intermediate and shorter sealing ring 18 and the generally flat and upwardly facing top portion 13 of the container rim. When the closure cap 1 has been turned or otherwise moved downwardly to this sealing position, an effective vapor proof seal results between the closure cap 1 and the container 12 with a significant sealing area being provided between the sealing ring 11 and the container run corner 14 as well as a secondary or continuing seal between the secondary ring 18 and the upwardly facing surface 13 of the container rim 10.

Figure 5:
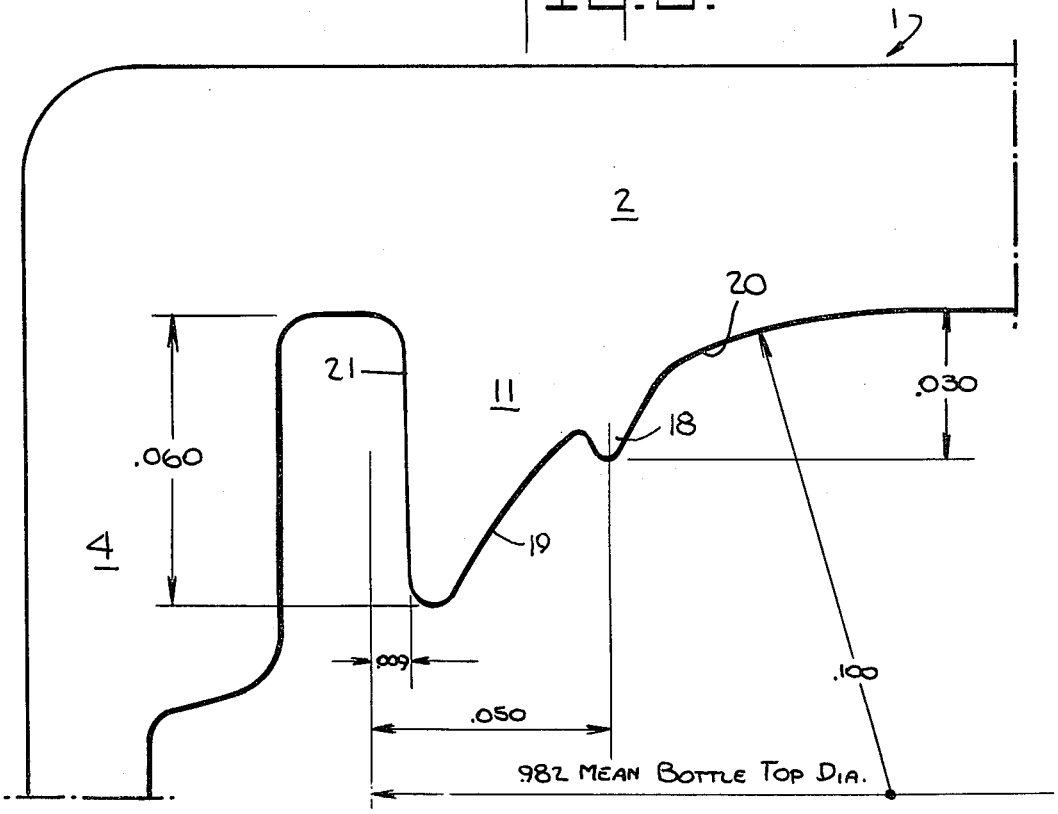
FIG. 5 is an enlarged detailed sectional view illustrating the improved sealing ring of the closure cap.

FIG. 5 illustrates in greater detail the preferred form of the sealing ring 11 and its relationship to the skirt 14 and cover 2 of the closure cap 1 as well as its preferred shaping for the downwardly and inwardly facing surfaces which provide the seal between the closure cap 1 and the container 12.

Certain representative dimensions and radii are shown for a typical bottle of about a 28 mm size.

The sealing ring 11 comprises a downwardly directed projection having a generally triangular cross section. The ring 11 has a principal lower sealing surface which comprises flared and a rounded inner sealing surface 19 which is interrupted by the downwardly directed and shorter sealing ring 18 also having a generally triangular cross section. The radially innermost surface 20 of the ring 11 extends inwardly and upwardly to the lower surface a of the molded container cover 2. The radially outermost surface 21 of the ring 11 is generally cylindrical.

For closure caps of 28 mm typical dimensions in inches are shown in FIG. 5 to facilitate the showing of the preferred shape of ring 11 and the relative proportions of the surfaces and other elements.

A preferred plastic is polypropylene. Others may be used.

As various changes may be made in the form, construction and arrangement of the invention and without departing from the spirit and scope of the invention, and without sacrificing any of its advantages, it is to be understood that all matters herein are to be interpreted as illustrative and not in a limiting sense.

The embodiments of the invention in which an exclusive property or privilege is claimed are defined as follows:

1. In a one-piece molded closure cap having a cover and a depending skirt with container engaging means on the skirt for engaging cap engaging means on the container rim finish below a closure engaging edge on the outside of the rim, the improvement comprising a circular sealing portion on the underside of the cap cover having a flared and concave curved inner sealing surface for sealing engagement with the container rim outer edge and having a shorter downwardly projecting sealing ring positioned intermediate the edges of said rim, said circular sealing portion comprising a downwardly projecting sealing ring having a generally triangular cross-section with the flared and curved surface being the hypotenuse of the triangle.

2. The closure cap as claimed in claim 1 in which the shorter sealing ring has a generally triangular cross-section and is positioned for engaging an upwardly facing surface of the container finish inwardly of the container outer rim corner.

3. In a sealed package including a container sealed with one-piece molded closure cap having a cover and a depending skirt with container engaging means on the skirt for engaging cap engaging means on the container rim finish below a container engaging edge on the outside of the rim, the improvement comprising a circular sealing portion on the underside of the cap cover having a flared and curved inner sealing surface in sealing engagement with an outer edge on the top of the container rim and also having a shorter downwardly projecting sealing ring positioned intermediate the margins of said sealing surface.

4. The sealed package as claimed in claim 3 in which said outer edge on the container comprises a step.

5. The sealed package as claimed in claim 3 in which said outer edge on the container comprises a rounded surface.

6. The sealed package as claimed in claim 3 in which said shorter circular sealing ring has a generally triangular cross-section.

* * * * *